United States Patent [19]

Reitner

[11] 4,134,669

[45] Jan. 16, 1979

[54] DRUM SUPPORT FOR ELECTROSTATIC PRINTER

[75] Inventor: Wilhelm Reitner, Taufkirchen, Germany

[73] Assignee: Siemens Aktiengesellschaft, Berlin & Munich, Germany

[21] Appl. No.: 842,608

[22] Filed: Oct. 17, 1977

[30] Foreign Application Priority Data

Apr. 18, 1977 [DE] Fed. Rep. of Germany ..... 2717055

[51] Int. Cl.[2] ..... G03G 15/00

[52] U.S. Cl. ..... 355/3 DR; 29/123

[58] Field of Search ..... 355/3 DR, 3 R; 29/123; 101/375, 378

[56] References Cited

U.S. PATENT DOCUMENTS

| | | | |
|---|---|---|---|
| 3,099,856 | 8/1963 | Eichorn et al. | 15/256.52 |
| 3,324,791 | 6/1967 | Cassano et al. | 100/172 |
| 3,536,397 | 10/1970 | Wagner | 355/3 DR |
| 3,536,485 | 10/1970 | Roth et al. | 355/3 DR |
| 3,770,345 | 11/1973 | Kawakubo et al. | 355/3 DR |
| 3,784,297 | 1/1974 | Ito et al. | 355/3 DR |
| 3,804,512 | 4/1974 | Komori et al. | 355/3 DR |
| 3,834,808 | 9/1974 | Takahashi et al. | 355/3 DR |
| 3,861,863 | 1/1975 | Kudsi | 432/60 |
| 3,994,053 | 11/1976 | Hunt | 355/3 DR |

*Primary Examiner*—Richard L. Moses

*Attorney, Agent, or Firm*—Hill, Gross, Simpson, Van Santen, Steadman, Chiara & Simpson

[57] ABSTRACT

A support for an intermediate carrier drum of the type used in electrostatic printers and copiers. A hollow drum is supported on a rotating shaft at both axial ends of the drum by shaft carried flange structures. One flange structure is fixed to the shaft and the other is removable therefrom at a free end of the shaft. A detachable extension of the free end carries a spring biasing member which urges the free end adjacent flange member toward the fixed flange entrapping the drum therebetween.

14 Claims, 1 Drawing Figure

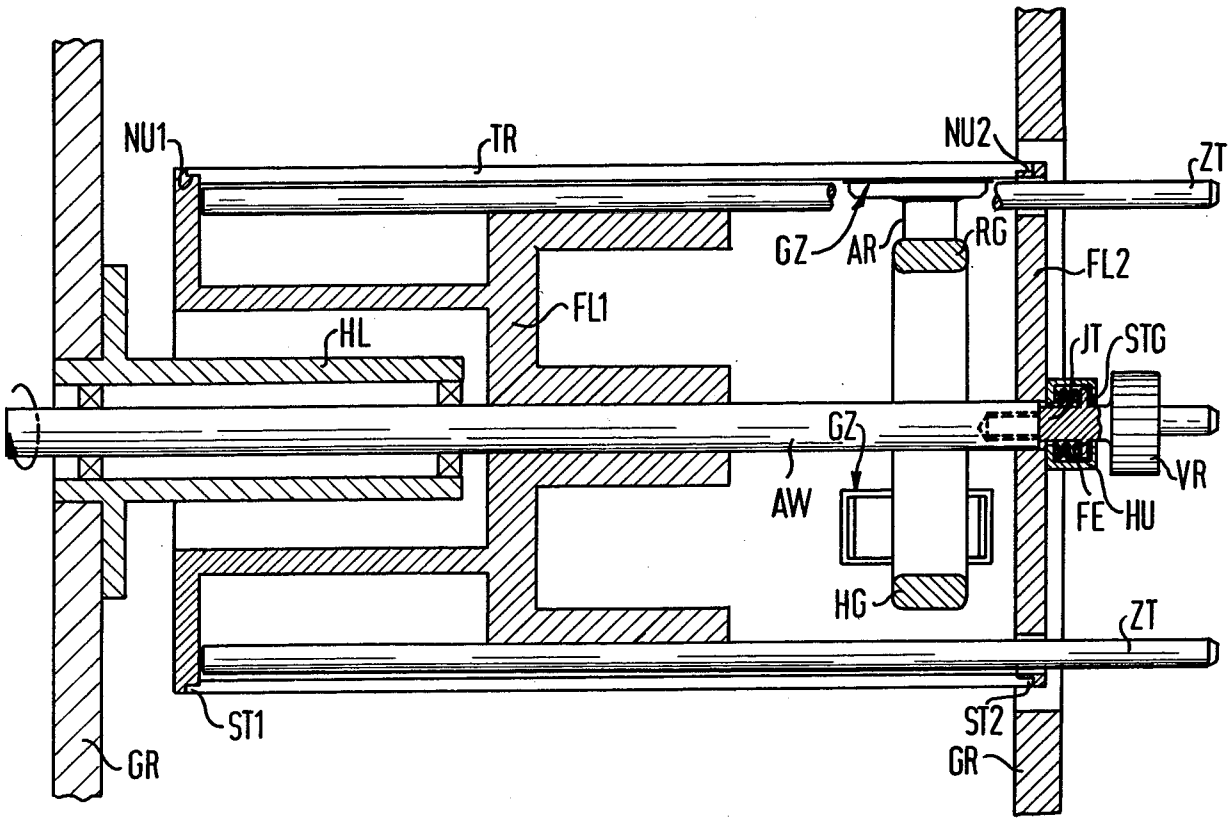
ZT
FL2
NU2
RG
AR
GZ
TR
NU1
STG
JT
VR
HU
FE
GZ
AW
FL1
HL
ZT
HG
ST2
GR
ST1
GR

DRUM SUPPORT FOR ELECTROSTATIC PRINTER

BACKGROUND OF THE INVENTION

1. Field of the Invention

This invention relates to electrostatic copiers, more particularly to an intermediate carrier drum support.

2. Prior Art

Nonmechanical printers and copiers are two examples of devices which utilize electrostatic principles for producing printed material. The term electrostatic copier is herein used to describe all such equipment utilizing electrostatic principles to transfer a printing material, such as toner, to a final carrier, such as paper. Such devices are well-known from published literature including, for example, U.S. Pat. No. 3,861,863. In such devices, toner images of the desired character are produced on a data carrier, such as a paper web or sheet. The toner images can be created by formation of a latent or charged image on a photoelectric or dielectric intermediate carrier, such as a drum. The latent image can be generated electrographically or electrophotographically or by other means. The latent or charge images are then developed by application of toner material at a developer station. The toner image is subsequently transferred to the data carrier at a transfer station. Thereafter, in order to prevent blurring of the toner image, it can be subsequently fused into the data carrier at a fixing station.

In such devices, the intermediate carrier may comprise a drum which has a circumferential layer on which the charge latent image of the character to be copied can be generated. Due to the nature of such layers, it is necessary to provide for replacement and servicing of the drums. To this end, the drum must be so mounted that it can be removed and replaced without damage, and particularly without damaging the drum outer layer.

SUMMARY OF THE INVENTION

It is, therefore, a general object of this invention to provide a support arrangement for intermediate carrier drums used in electrostatic copiers which avoids damage to, and impairment of, the drum layer.

This general objective is achieved by fixing a first drum locating radially projecting flange to the drum drive shaft with the flange being equipped with an offset ledge or groove into which a corresponding configuration at one end of the drum can be inserted. A second drum locating radially extending flange is centered on and movable on the drive shaft having at its rim a similar configuration into which a mating configuration at the other end of the drum can be inserted. A screw threaded member attachable into a tapped bore in the free end of the drive shaft to lie outboard of the second flange carries a spring means which urges the second drum locating flange into contact with the drum and the drum into contact with the first drum locating flange.

In order to facilitate insertion and removal of the drum, it is convenient to fix centering rods to the first drum locating flange, the centering rods having outer surfaces on which the drum interior can slide. It is possible by this method to center the drum before the drum end configuration reaches the first locating flange so that the drum will be centered thereon. Further, this prevents possible contact with other parts of the unit during drum insertion.

The threaded member attachable to the free end of the shaft is designed so as to allow the drum to run circularly without eccentricity on the shaft. To this end, it is important that, at the time of assembly, no distortion should be applied. This is achieved by a construction of the threaded free end extension which provides a first internal component having a radial projection, the component having a thread end designed to be screwed into the shaft. A sleeve is freely received around the internal component and may have radially inwardly extending portions abutting with the radial projection of the internal component to maintain the sleeve in position on the internal component while retaining axial movability of the sleeve on the component. Spring means are interposed between the radial projection of the internal component and the sleeve urging the sleeve axially away from the radial projection in the direction of the second drum locating flange. Thus, when the internal component is screwed onto the free end of the shaft after the second drum locating flange has been positioned on the shaft, the springs will force the sleeve against the second drum locating flange which, in turn, will press against the drum and load the drum against the first locating flange. By use of a free floating slightly radially movable sleeve, it is assured that no distortions will be applied during assembly.

It has also been found desirable to provide a handle inside the drum. To this end, a spoked handle having a preload dimension can be used. Rubber inserts can be positioned between the radially outer ends of the spokes of the handle and the interior of the drum. The preload construction of the handle is such that the rubber inserts will be pressed against the interior of the drum to automatically secure the handle to the drum.

It is also preferable to support the drive shaft of the drum in bearings at one end only of the drum chamber. Thus, the drive shaft bearings can be positioned in a sleeve attached to the equipment frame with the shaft projecting therefrom. The sleeve may extend into the drum interior and the first flange may be axially offset radially outward of the bearing sleeve. The other end of the shaft, the free end, is thus unsupported.

During assembly of the drum, the second drum locating flange is slid over the free end and preferably has a very small or zero clearance so as to assure that the second flange will be concentric with the shaft. The free end extension is thereafter screwed onto the shaft end.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWING

The FIGURE is a fragmentary cross section of the intermediate carrier drum compartment of an electrostatic copier.

DESCRIPTION OF THE PREFERRED EMBODIMENT

FIG. 1 illustrates only that portion of the copier machine which includes the intermediate carrier drum chamber. The remaining structure of the copier is not shown and is not necessary to an understanding of this invention. Overall structure of such copiers is known from the art.

The copier includes an equipment frame GR. A drum TR is positioned interiorly thereof. To drive the drum TR, a rotatable drive shaft AW is provided which may be rotatably supported by a bearing assembly including sleeve HL attached to the frame GR. The drive shaft AW is normally motor rotated by motor means not illustrated here. The bearing sleeve HL is rigidly affixed to the equipment frame such that the shaft AW is firmly positioned within the equipment frame although being held adjacent the one end only with a projecting free end.

A first drum locating flange FL1 is rigidly affixed to the drive shaft between the free end of the drive shaft and the sleeve HL. As illustrated, the first drum locating flange may extend axially back over the sleeve HL before axially terminating in a radially outwardly extending wall portion. The flange FL1 is provided with a peripheral configuration NU1 which mates with a corresponding configuration ST1 at an axial end of the drum TR. In the embodiment illustrated, indexing end-face ledges are shown for the mate between the drum axial end and the flange peripheral end. Of course, it is to be understood that other configurations could be used; however, the configuration is preferably such as that the drum axial end can axially bottom against the flange while at the same time being precisely radially positioned on the flange with respect to the shaft center.

A second drum locating flange FL2 is received on the shaft AW at the free end thereof in a centered sliding relation. The second flange likewise is equipped with a peripheral configuration NU2 which mates with a mating configuration ST2 on the axial end of the drum. Once again, although overlapping ledges are shown, other configurations can be utilized, such as: tongue and groove; a single drum end inner diameter ledge; a single flange periphery ledge, or the like.

The drum is fixedly held in position with respect to the shaft by means of the flanges FL1 and FL2. A free end extension VR of the shaft end is used to lock up the assembly. The free end extension VR includes an internal component JT having a threaded end which is receivable in a tapped bore in the end of the shaft AW to attach the extension VR to the shaft after assembly of the flange FL2 onto the free end. The internal component JT is provided with a radial projection STG. Additionally, the internal component can be provided with a knurled handwheel to facilitate attachment to the shaft free end. A sleeve HU is received on the internal component JT in a free floating clearance relationship. The sleeve HU has inturned axial ends having an inner diameter less than the outer diameter of the projection STG so that axial movability of the sleeve is limited. Spring means FE are compressed between the radial projection STG and the radially inturned axial end face of the sleeve HU adjacent the flange FL2.

Proper lock-up of the drum TR on the drum locating flanges FL1 and FL2 is accordingly obtained by means of the free end extension VR at the time of threading the extension VR into the tapped hole in the end of the shaft AW. During threading, the radial projection STG forces the spring FE against the sleeve HU to urge the sleeve against the flange FL2. The consequence of this, of course, is that the drum TR is forced by the flange FL2 against the first flange FL1 which is rigidly mounted on the drive shaft thereby fixing the drum in position.

In order to center the drum TR during assembly, centering rods ZT are attached to the first flange FL1. As illustrated, the first flange may have radially extending portions spaced from the flange end portion which contacts the axial end of the drum, which radially extending portions form an attachment support for the rods ZT. The rods ZT then define a limited area for receipt of the drum TR. For example, four such rods ZT may be provided which are offset from one another at angles of 90°. The centering rods ZT are so positioned and arranged such that at the time of assembly, the drum TR can be slid onto them and the drum thereafter guided until the mating configurations between the drum end and the flange FL1 have properly located the drum on the flange. To this end, the centering rods ZT will preferably extend beyond the drum removal opening in the equipment frame GR and beyond the flange FL2 at the time of complete assembly, the flange FL2 thus being equipped with circumferentially spaced openings for receipt of the centering rods ZT. In this way, centering of the drum commences right at the start of the assembly, that is, even prior to the time the drum TR is able to come into contact with the equipment frame.

Assembly of the drum is facilitated by providing a handle HG on the interior of the hollow drum. The handle HG can be formed of a synthetic material having sufficient elasticity to be preloaded. The handle can, therefore, consist of a ring RG having radially outwardly projecting spokes AR which extend to the interior surface of the drum. In order to allow the handle to automatically adhere to the drum interior, rubber inserts GZ can be interposed between the ends of the spokes AR and the drum inner diameter. Because of the preload, the spokes will press the inserts GZ against the drum interior, and the rubber will adhere sufficiently to the drum interior to provide a secure connection of the handle to the drum. The handle would, therefore, facilitate insertion and removal of the drum. Of course, it is also possible to attach the handle to the drum interior by means such as adhesives and the like.

This invention greatly facilitates assembly of the drum TR. Prior to assembly, the sleeve HL is affixed to the equipment frame GR and the drive shaft AW is rotatably mounted in the sleeve. Furthermore, the flange FL1 is fixedly attached to the drive shaft AW and the centering rods ZT are rigidly fixed on the flange FL1. To carry out assembly, the drum TR is slid onto the centering rods ZT and moved in the direction of the first drum locating flange FL1. The centering rods ZT provide a first centering action with the main centering action being between the indexing configurations ST1 and NU1. Subsequently, the second drum locating flange FL2 is slid onto the centering rods ZT and in so doing is properly aligned with the drive shaft AW. The flange FL1 is then slid onto the drive shaft AW and the mating configurations ST2 and NU2 are engaged.

Attachment of the drum is completed with the help of the free end extension VR. In this context, the internal component JT is threaded onto the free end of the drive shaft AW and, under urging of the springs FE, the sleeve HU loads the flange FL2 against the drum TR and the drum TR against the flange FL1. Thus, the drum TR will be properly attached to and centered on the flanges FL1 and FL2 thereby completing assembly.

A main advantage of the drum support assembly according to this invention lies in the fact that drum changing can be carried out without having to touch the drum layer which takes the charge images. Furthermore, the drum can be assembled as an individual loose part.

The invention provides an economical and non-wearing centering device which prevents damage to the drum as a consequence of preventing impact against other parts of the equipment. Finally, the drum rotates concentrically with the shaft without any eccentricity, at least in part because of the novelty of the design of the free end extension which, due to the spring-loaded free sleeve, maintains the drum in engagement with the flanges without developing stresses at the time of the assembly thereby precluding damage to the drum layer which might otherwise occur due to stress distortions created at the time of drum assembly into the copying machine.

Although the teachings of my invention have herein been discussed with reference to specific theories and embodiments, it is to be understood that these are by way of illustration only and that others may wish to utilize my invention in different designs or applications.

I claim as my invention:

1. A mounting assembly for supporting a tubular drum used as an intermediate carrier in an electrostatic copier supporting the drum on a drive shaft comprising: a first drum locating radially projecting flange fixed on said drive shaft provided with a groove adjacent its outer peripheral rim into which a mating configuration groove located at one axial end of the drum can be inserted, a second drum locating radially projecting flange axially movably received on said drive shaft and centered thereon and provided with a groove adjacent its radial peripheral edge into which a mating groove configuration located at the other end of the drum can be inserted, a shaft end extension member detachable from a shaft end adjacent the second drum locating flange, spring means associated with the shaft end extension, said spring means effective, when the shaft end extension is attached to the shaft end adjacent the second flange to spring urge the second flange axially towards the first flange and to urge the second flange into contact with the drum and the drum into contact with the first flange.

2. A device according to claim 1 wherein the first drum locating flange supports a plurality of circumferentially spaced apart centering rods which extend coaxial with the shaft and which are spaced from one another to provide a drum inner diameter contact surface upon which the drum can be slid, the centering rods substantially centering the drum with respect to the shaft.

3. A device according to claim 2 wherein four centering rods are provided offset at angular intervals of 90°.

4. A device according to claim 1 wherein the shaft end extension comprises an internal component having a radial projection and a threaded end, the shaft having an internal tapped bore at a free end thereof, the internal component being threadable into the bore, a sleeve axially movably received around said internal component, means limiting axial movability of said sleeve, spring means interposed between said radial projection of said internal component and said sleeve urging the said sleeve towards the threaded end of the internal component.

5. A device according to claim 4 wherein the drum is hollow and has a handle disposed therein.

6. A device according to claim 5 wherein the handle is radially preloaded in such a manner that it adheres to the drum inner diameter surface through interposed rubber pads.

7. A device according to claim 4 wherein the drive shaft is supported in bearings supported by a frame of the copier with the shaft projecting therefrom and terminating in a free end, the bearings being received in a sleeve fixedly attached to the frame.

8. A mounting assembly for rotatably mounting an intermediate carrier drum in an electrostatic printing device comprising: a rotatable shaft carried by said device having a projecting free end, a first radially extending drum locating flange member attached to said shaft and rotatable therewith having a radially extending face, a first groove in said face adjacent an outer periphery of the flange, a second radially extending drum locating flange member slidably received on said shaft adjacent said free end having a second radially extending face with a second groove in said second face adjacent an outer periphery of the second face concentric with the first groove on the shaft, a cylindrical drum having axial end faces having mating configurations indexable with said grooves to mount said drum on said flanges extending therebetween, a locking component detachably carried by said free end with portions thereof extending beyond said second flange away from said drum, abutment means carried by said portions resiliently urging said second flange towards said first flange and maintaining said second flange on said shaft.

9. A drum support for an intermediate carrier drum in electrostatic copiers comprising a copier frame rotatably supported shaft having a drum carrying projecting free end portion extending beyond the frame support terminating in a free end, a first flange member fixedly attached to said shaft having a radially extended portion adapted to provide a first axial end support for a first end of a hollow interior drum with the drum axially bottomed thereagainst, a second flange member having a central bore for close tolerance receipt on the shaft, the second flange member being receivable over the free end spaced from the first flange and having a radially extended portion adapted to provide a second axial end support for a second end of the drum with the drum axially bottomed thereagainst, said drum received between and supported on said radially extending portions, a shaft free end attachable member projecting from said free end beyond said second flange having spring means acting on said second flange urging said second flange into contact with said drum and said drum into contact with said first flange.

10. The device of claim 9 including a plurality of circumferentially spaced apart axially extending rod members carried by said shaft intermediate portions of the flanges, said rod members providing drum supporting slide surfaces effective to center said drum on said shaft before said drum is engaged by said flanges whereby the drum can be slid on said rods over the free end toward the first flange.

11. The device of claim 10 wherein the rods project beyond the free end.

12. The device of claim 9 wherein the free end attachable member comprises an inner component having a threaded end portion, a radial projection spaced from the threaded end portion, a sleeve member freely received around said inner component having an axial dimension with radially inturned legs at axial ends thereof, the inturned legs having an inner diameter less than the outer diameter of the radial projection whereby the sleeve is maintained on the internal component, spring means interposed between the radial projection and the inturned leg adjacent the threaded end.

13. The device of claim 12 wherein the shaft has an internal tapped bore into which the threaded end of the internal component is threadable.

14. The device according to claim 10 wherein portions of the first flange provides support for the rods.

* * * * *